US007464714B2

(12) United States Patent
Kim

(10) Patent No.: US 7,464,714 B2
(45) **Date of Patent: *Dec. 16, 2008**

(54) MASCARA BRUSH

(75) Inventor: Yoon Hoi Kim, Seoul (KR)

(73) Assignee: RND Group LLC., Englewood Cliffs, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/797,261

(22) Filed: May 2, 2007

(65) Prior Publication Data

US 2007/0204874 A1 Sep. 6, 2007

Related U.S. Application Data

(62) Division of application No. 10/834,974, filed on Apr. 30, 2004, now Pat. No. 7,231,926.

(30) Foreign Application Priority Data

May 9, 2003 (KR) ..... 10-2003-29373
Nov. 14, 2003 (KR) ..... 10-2003-80499

(51) Int. Cl.
*A45D 40/26* (2006.01)
*A45D 24/16* (2006.01)

(52) U.S. Cl. ..... 132/218; 132/120

(58) Field of Classification Search ..... 132/120, 132/148, 218; 15/206; 401/9, 10
See application file for complete search history.

(56) References Cited

U.S. PATENT DOCUMENTS

| | | | | |
|---|---|---|---|---|
| 2,226,318 | A | 12/1940 | Nelson | |
| 2,515,094 | A | 7/1950 | Fannie | |
| 2,569,908 | A | 10/1951 | Twitty | |
| 2,617,432 | A | 11/1952 | Hertzberg | |
| 3,908,676 | A | 9/1975 | Levine et al. | |
| 3,921,650 | A | 11/1975 | Montgomery | |
| 4,403,624 | A | 9/1983 | Montgomery | |
| 5,007,442 | A | 4/1991 | Hirzel | |
| 6,408,857 | B1 | 6/2002 | Neuner | |
| 7,089,946 | B2 * | 8/2006 | Rousselet | 132/218 |

* cited by examiner

*Primary Examiner*—Robyn Doan
(74) *Attorney, Agent, or Firm*—Lowe Hauptman Ham & Berner, LLP

(57) ABSTRACT

The present invention relates to a mascara brush. The present invention provides a mascara brush, wherein a single brush rod of the mascara brush is formed with both an application brush part with an application portion for applying a mascara liquid to eyelashes and an arrangement brush part with a comb for arranging the eyelashes in order to simultaneously perform the application of the mascara liquid and arrangement of the eyelashes, thereby conveniently imparting the effects of clean, long lash and curling to the eyelashes through a single process, the structure of the mascara brush is simplified so that a manufacturing process can be relatively simplified, and stability in use can be obtained due to the securely coupled state.

1 Claim, 16 Drawing Sheets

MASCARA BRUSH

CROSS REFERENCE TO RELATED APPLICATION

This application is a divisional of U.S. Ser. No. 10/834,974, filed on Apr. 30, 2004 now U.S. Pat. No. 7,231,926. This application, in its entirety, is incorporated herein by reference.

BACKGROUND OF THE INVENTION

1. Field of the Invention

The present invention relates to a mascara brush, and more particularly, to a mascara brush, wherein an application portion as a means for applying a mascara liquid to eyelashes and a comb for arranging the eyelashes are simultaneously formed on a single brush rod so that the application of the mascara liquid to the eyelashes and the arrangement of the eyelashes can be performed at one time.

2. Description of the Prior Art

Mascara is one of cosmetics used by women to apply mascara liquids of various colors to their eyelashes so that their eyes can look better in an esthetic sense. Generally, as shown in FIG. 18, a mascara brush 100 comprises a container 150 for containing a mascara liquid, a grip 160 for opening and closing the container 150, a brush rod 120 extending downwardly from the grip 160, and a brush part 130 formed at the brush rod 120. The mascara liquid is used in such a manner that the brush part 130 is smeared with the mascara liquid through engagement or disengagement of the grip 160 to or from the container 150.

Particularly, depending on the length and configuration of the bristles, the mascara brush 100 constructed as above is manufactured to be adapted to various functions such as volume-up (effect of allowing eyelashes to be seen abundantly), curling (effect of upwardly curling distal ends of eyelashes), long lash (effect of allowing eyelashes to appear longer) and clean (effect of preventing eyelashes from being entangled) for eyelashes.

As shown in FIG. 18, the conventional mascara brush that has been typically used is manufactured in such a manner that bristles 131 of the brush part 130 with a generally constant length are disposed between two stands of wires and the wires are then twisted several times so that the brush part 130 can have a cross section in the form of any of various shapes including circular, triangular and sectorial shape about a wire shaft 121. The effects of volume-up, curling, long lash and clean can be obtained with respect to the respective shapes of the cross section of the brush part 130.

The basic function of the mascara brush is to evenly apply a viscous mascara liquid to eyelashes and to appropriately comb the eyelashes by means of the brush part so that the eyelashes are not entangled. Since the bristles 131 extend radially along a helical path due to the twisting of the wires in the conventional mascara brush 100, a great deal of mascara liquid can be accommodated between the respective bristles 131. Thus, the conventional mascara brush can make the eyelashes appear voluminous. However, eyelashes often become entangled due to the viscosity of the mascara liquid. Accordingly, there is inconvenience in that the eyelashes should be arranged using an additional arranging instrument, or make-up application should be performed again after the excess mascara liquid is removed.

A mascara brush 200 for solving the entanglement phenomenon of eyelashes of the previous mascara brush, as shown in FIG. 19, comprises a brush rod 220 of which a lower end has a diameter smaller than that of an upper end thereof, and a brush part 230 that is formed at a side surface of the lower end of the brush rod and has bristles 231 formed by a separate manufacturing apparatus from the same synthetic resin material as the brush rod 220 and then fixed to the brush rod 220. The bristles 231 are arranged longitudinally in a line on the side surface of the lower end of the brush rod 220 to take the shape of a linear comb. Thus, when a mascara liquid is applied to eyelashes, it is applied to the eyelashes while permeating through the eyelashes due to the combing of the linear brush part 230. Accordingly, the effects of clean and long lash can be obtained.

Meanwhile, the bristles 231 of the mascara brush 200 are formed of a material similar to a material for the brush rod 220, which is a synthetic resin such as polyamide. The bristles 231 are completed by slitting a mass of the synthetic resin constructing the brush part 230 into fine strands. In view of properties of the synthetic resin, however, the bristles 231 cannot be formed finely to such as extent as the bristles 131 of the conventional mascara brush 100 shown in FIG. 16. Further, since the wide spacing of the respective bristles 231 deteriorates their capability to accommodate a mascara liquid, it is difficult to apply the mascara liquid in case of tufty or long eyelashes. Moreover, although the linearly arranged bristles 231 applies the mascara liquid to eyelashes in such a manner that they comb the eyelashes upon application of the mascara liquid, thereby preventing the entanglement phenomenon of the eyelashes, there is a problem in that the effects of volume-up and curling of the eyelashes are deteriorated.

SUMMARY OF THE INVENTION

The present invention is conceived to solve the aforementioned problems in the prior art. Accordingly, an object of the present invention is to provide a mascara brush, wherein a single brush rod of the mascara brush is formed with both an application brush part with an application portion for applying a mascara liquid to eyelashes and an arrangement brush part with a comb for arranging the eyelashes in order to simultaneously perform the application of the mascara liquid and arrangement of the eyelashes, thereby conveniently imparting the effects of clean, long lash and curling to the eyelashes through a single process, the structure of the mascara brush is simplified so that a manufacturing process can be relatively simplified, and stability in use can be obtained due to the securely coupled state.

According to the present invention for achieving the object, there is provided a mascara brush, comprising an application brush part with an application portion formed on an outer circumferential surface of a rod thereof to apply a mascara liquid to eyelashes; and an arrangement brush part including a fixing stand coupled to the application brush part, and a comb formed on an outer peripheral surface of the fixing stand. The application brush part is formed with a cutaway portion by longitudinally cutting away a section of the application portion, and the comb is placed in the cutaway portion so that the arrangement brush part can be integrated with the application brush part.

The rod of the application brush part may be constructed by twisting parts of a metal wire, and the application portion may be fixedly formed by interposing a plurality of bristles between the parts of the metal wire and twisting the parts of the metal wire.

The rod of the application brush part may be injection molded from a synthetic resin such that the application portion is formed on the outer circumferential surface of the rod.

The fixing stand may be sized to correspond to the cutaway portion of the application brush part, an upper end of the fixing stand may be formed with a fitting hole into which the rod is fixedly inserted and a lower end of the fixing stand may be formed with a fitting recess into which a distal end of the rod on the side of the application portion is fixedly inserted, and the comb may be formed on a side surface of the fixing stand in a longitudinal direction of the fixing stand.

The fixing stand may be formed to take the shape of a cylinder and formed with a central insertion bore longitudinally therethrough so that the rod can be inserted into the insertion bore, a lower end of the fixing stand may be formed with a fitting recess into which a distal end of the rod on the side of the application portion is fixedly inserted, both sides of the fixing stand may be perforated to have open windows such that existing sections of the application portion of the application brush part protrude outwardly through the windows, and the comb may be formed on a side surface of the fixing stand in a longitudinal direction of the fixing stand.

A section of the application portion fixed at the distal end of the rod on the side of the application portion may be removed and a ring may be formed to be exposed at the distal end of the rod.

A distal end of the rod with the application portion injection molded thereon may be performed to form a ring.

The arrangement brush part coupled to the application brush part may comprise the fixing stand for fixing and supporting the application brush part, and the comb formed on a side surface of the fixing stand, the fixing stand may be sized to correspond to the cutaway portion of the application brush part, an upper end of the fixing stand may be formed with a fitting hole into which the rod is fixedly inserted, and a lower end of the side surface may be formed with a protruding, coupling piece adapted to be fixedly inserted into the ring of the rod.

The arrangement brush part coupled to the application brush part may comprise the fixing stand for fixing and supporting the application brush part, and the comb formed on a side surface of the fixing stand, the fixing stand may be formed to take the shape of a tube and formed with a central insertion bore longitudinally therethrough so that the rod of the application brush part can be inserted into the insertion bore, both sides of the fixing stand may be perforated to have open windows such that existing sections of the application portion of the application brush part protrude outwardly through the windows, and a lower end of the side surface may be formed with a protruding, coupling piece adapted to be fixedly inserted into the ring of the rod.

The cutaway portion may be formed in an angular range of 30 to 120 degrees about the center of the cross section of the application brush part.

The cutaway portions may be formed by cutting away lateral side sections of the application portion that are symmetric with each other with respect to the cross section of the application brush part.

One or more columns of combs may be formed on the arrangement brush part in a longitudinal direction of the fixing stand.

A plurality of columns of combs are formed on the fixing stand in a zigzag manner.

BRIEF DESCRIPTION OF THE DRAWINGS

The above and other objects, features and advantages of the present invention will become apparent from the following description of preferred embodiments given in conjunction with the accompanying drawings, in which:

FIGS. 17*a*, and 17*b* and 17*c* are a front view and bottom views showing that a ring portion is formed at a lower end of a rod of the application brush part of FIG. 16*a.

DESCRIPTION OF THE PREFERRED EMBODIMENTS

Hereinafter, preferred embodiments of a mascara brush of the present invention will be described in detail with reference to the accompanying drawings.

Figure 1:
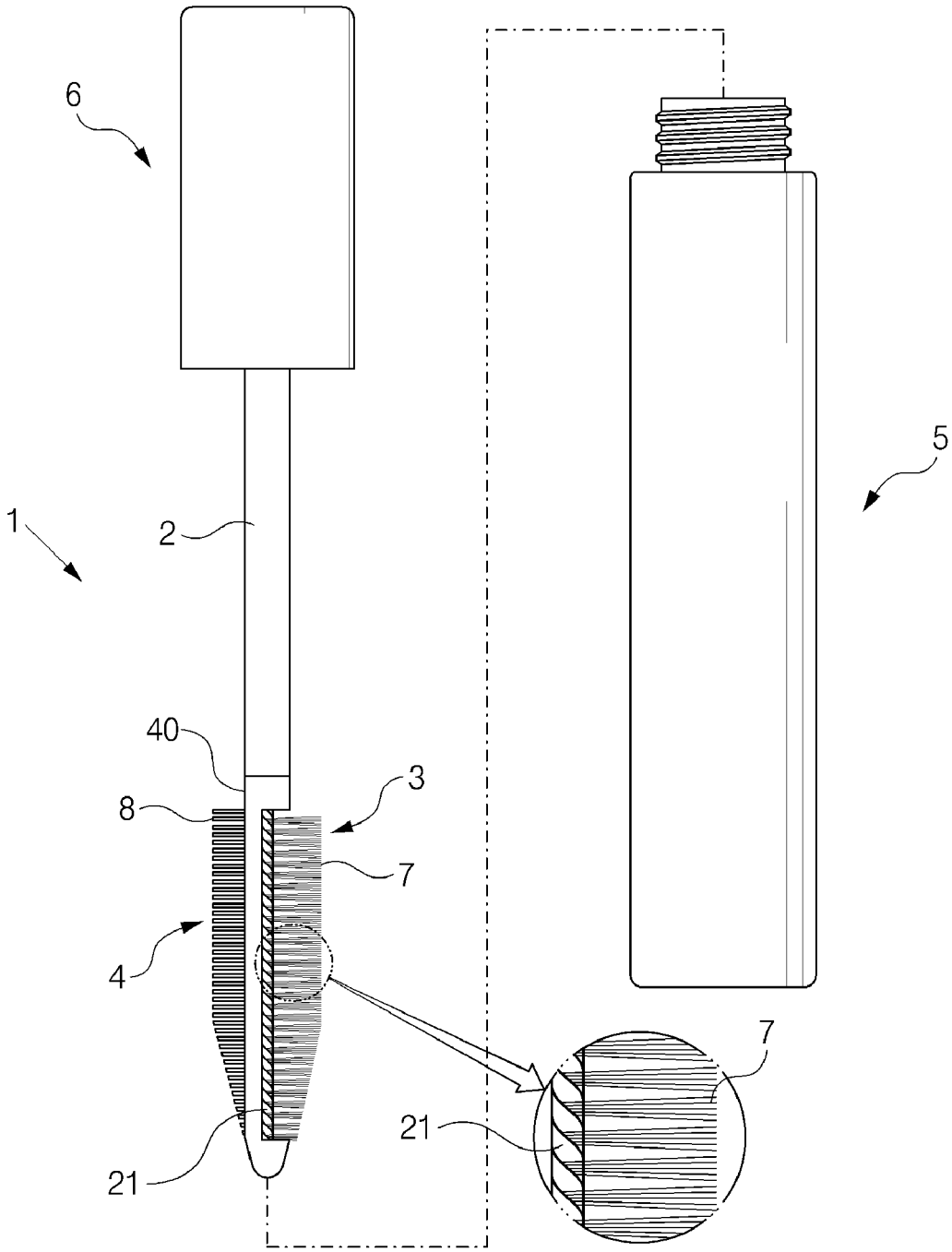
FIG. 1 is a front view of a mascara brush according to a first embodiment of the present invention.

FIG. 1 is a view showing a mascara brush according to a first embodiment of the present invention in a disengaged state. The mascara brush 1 comprises a container 5 for containing a mascara liquid, a grip 6 for opening and closing the container 5, a brush rod 2 extending downwardly from the grip 6, and an application brush part 3 and an arrangement brush part 4 formed at a lower end of the brush rod 2.

The brush rod 2 fixed to the grip 6 is in the form of a rod which has a predetermined length such that it can be inserted into the container 5 and the application brush part 3 can be then smeared with the mascara liquid, and has a diameter smaller than that of a mouth of the container 5 such that it can pass through the mouth of the container 5. At the lower end of the brush rod 2, a rod 21 with the application brush part 3 fixed thereto is coupled to a fixing stand 40 formed with the arrangement brush part 4.

Figure 2:
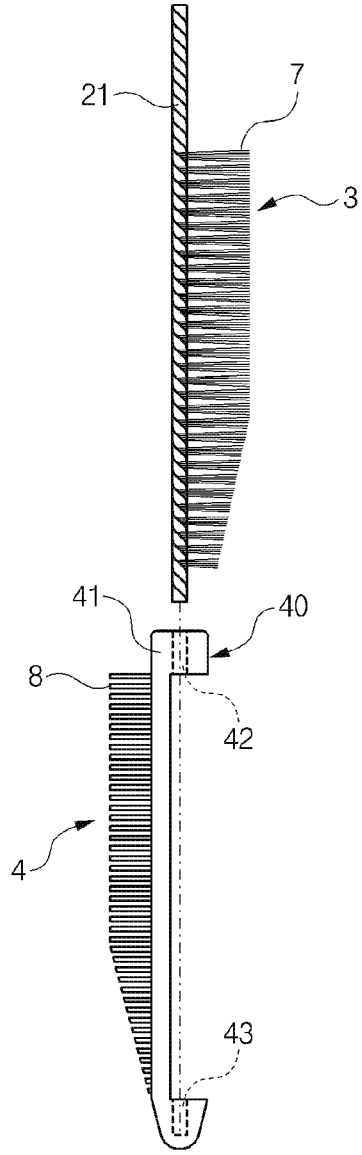
FIG. 2 is a front view showing a state where an application brush part and an arrangement brush part of the mascara brush shown in FIG. 1 are separated from each other.

FIG. 2 is a front view showing a state where the application brush part and the arrangement brush part are separated from each other.

The application brush part 3 is a means for receiving the mascara liquid and applying it to eyelashes. The application brush part 3 is constructed by interposing a plurality of bristles having a constant length between and perpendicularly to two parts of a metal wire folded at the center thereof and spirally twisting the two wire parts several times. Thus, the bristles are fixed radially to the rod 21 formed through the twisting of the wire parts, thereby forming an application portion 7.

Figure 3:
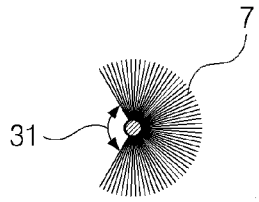
FIG. 3 is a bottom view of the application brush part of FIG. 2.

Further, as shown in FIG. 3, a side surface of the application brush part 3 is formed longitudinally (perpendicularly to the cross section of the application brush part 3) with a cutaway portion 31 by cutting away a section of the application portion 7 that is fixed to the wire shaft constructing the rod 21. At this time, the cutaway portion 32 is formed by longitudinally cutting away a section of the application portion 7 within an angular range of about 30 to 120 degrees about the center of the cross section of the application brush part 3.

Then, the application brush part 3 constructed as above is fixedly coupled to the lower end of the brush rod 2 to be integrated with the brush rod 2.

The arrangement brush part 4 shown in FIG. 2 is a means for arranging the eyelashes smeared with the mascara liquid by the application brush part 3, and has a comb 8 protruding from an outer surface of the fixing stand 40.

The fixing stand 40 is to fix the comb 8 to the cutaway portion 31 of the application brush part 3. The longitudinal length of the fixing stand 40 is identical with or slightly larger than that of the rod 21 extending the lower end of the brush rod 2. Upper and lower ends of the fixing stand 40 are formed with upper and lower flanges that extend in a direction perpendicular to a side surface 41 corresponding to the longitudinal length of the fixing stand 40 and have a diameter identical with that of the brush rod 2.

The upper flange of the fixing stand 40 is formed with a fitting hole 42 through which the rod 21 is inserted so that the fixing stand 40 is integrated with the application brush part 3. The lower flange of the fixing stand 40 is formed with a fitting recess 43 into which a distal end of the rod 21 on the side of the application portion 7 is fixedly inserted when the rod 21 inserted into the fitting hole 42 is lowered. Further, since the comb 8 formed on the side surface 41 of the fixing stand 40 is placed in the cutaway portion 31 formed in the application portion 7 of the application brush part 3, the cross section of the side surface of the fixing stand 40 takes the shape of a sector with a central angle of about 30 to 120 degrees corresponding to the shape of the cutaway portion 31. The fixing stand 40 is in the form of "⊏" as a whole.

The comb 8 has one or more teeth thereof protruding vertically from the side surface 41 of the fixing stand 40 in order to comb the eyelashes. The teeth of the comb 8 are formed in a line to protrude vertically from the side surface of the fixing stand 45 over a length similar to that of the application portion 7 fixed to the rod 21 of the application brush part 3. Here, the teeth of the comb 8 are injection molded using a precision mold from the same material as the fixing stand 40, i.e. natural resin, synthetic resin including polyamide, or the like, so that they can be formed to be thicker and more robust than the application portion 7 of the application brush part 3. The respective teeth of the comb 8 are formed in a line at an interval of about 0.1 to 1 mm. Accordingly, the arrangement brush part 4 takes the shape of a linear comb.

Figure 4:
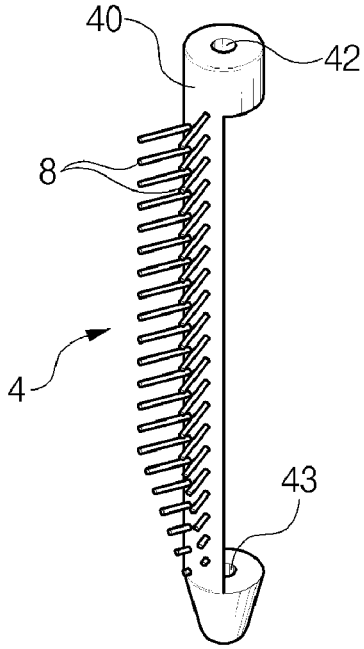
FIG. 4 is a perspective view showing that a plurality of columns of combs are formed at the arrangement brush part of FIG. 2.
Figure 5:
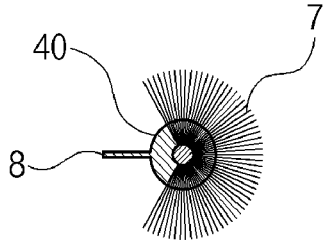
FIG. 5 is a bottom view showing a state where the application brush part of FIG. 2 and an arrangement brush part with a column of comb are coupled to a brush rod of the mascara brush.
Figure 6:
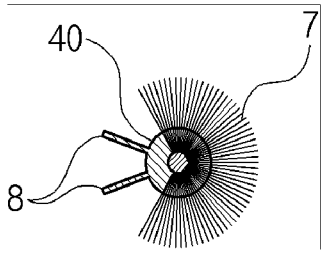
FIG. 6 is a bottom view showing a state where the application brush part of FIG. 2 and an arrangement brush part with a plurality of columns of combs are coupled to a brush rod of the mascara brush.

As for the comb 8 of the arrangement brush part 4, it is preferred that one or more columns of combs 8 be formed perpendicularly to the side surface 41 of the fixing stand 40, as shown in FIG. 4. Moreover, teeth of a column of comb 8 and teeth of the next column of comb may be formed to be in the same horizontal planes or to be staggered in a zigzag manner.

To fix the arrangement brush part 4 constructed as above to the application brush part 3, the fitting hole 42 of the fixing stand 40 is fitted around the rod 21, the fixing stand 40 is then adjusted in its position such that the side surface 41 of the fixing stand 40 is placed in the cutaway 32 of the application brush part 3, and the fitting recess 43 of the fixing stand 40 is fitted around the distal end of the rod 21 on the side of the application portion 7. Consequently, the fixing stand 40 and the rod 21 are coupled to each other.

Here, since the application portion 7 does not extend up to the distal end of the rod 21, the distal end of the rod 21 is press-fitted into the fitting recess 43 and the rod 21 is then fixedly coupled to the fixing stand 40 by means of various methods including adhesive bonding, thermal bonding and the like.

As described above, both the application brush part 3 and the arrangement brush part 4 are coupled to the single brush rod 2. Thus, the application brush part 3 is formed at a side of the brush rod 2 and the arrangement brush part 4 is formed at the other side of the brush rod 2 so that the mascara brush 1 can have an actiniform configuration as a whole.

Further, lower portions of the application and arrangement brush parts 3 and 4 of the mascara brush 1 are cut slantingly toward their distal ends to more easily facilitate access to short eyelashes located at either side of the eyelid.

Therefore, when the mascara brush 1 constructed as above is smeared with the mascara liquid and then used, the application brush part 3 with the application portion 7 receives a large amount of mascara liquid. Thus, when the mascara liquid is applied to the eyelashes by the application brush part 3 formed at a side of the mascara brush 1, the application portion 7 of the application brush part 3 comes into contact with the eyelashes and applies the mascara liquid to the eyelashes, thereby imparting volume-up effect to the eyelashes. Then, the eyelashes are arranged using the arrangement brush part 4 formed in the form of a comb at the other side of the mascara brush 1. The teeth of the comb 8 deeply penetrate between the respective eyelashes to prevent entanglement of the eyelashes and simultaneously support the eyelashes throughout the use of the arrangement brush part. Therefore, the effects of volume-up, long lash, curling and clean are exhibited.

At this time, since the linear comb 8 formed at the arrangement brush part 4 is also smeared with the mascara liquid, the effects of long lash, curling and clean can be imparted to the eyelashes even when the mascara liquid is applied to the eyelashes using only the arrangement brush part 4.

Moreover, when the mascara brush 1 having the arrangement brush part 4 with the plurality of columns of combs 8 is used, the plurality of staggered columns of combs 8 more easily penetrate between the eyelashes to apply the mascara liquid to the eyelashes. Therefore, even when only the arrangement brush part 4 formed with the plurality of columns of combs 8 is used, the effects of volume-up, long lash, curling and clean can be imparted to the eyelashes.

Figure 7A:
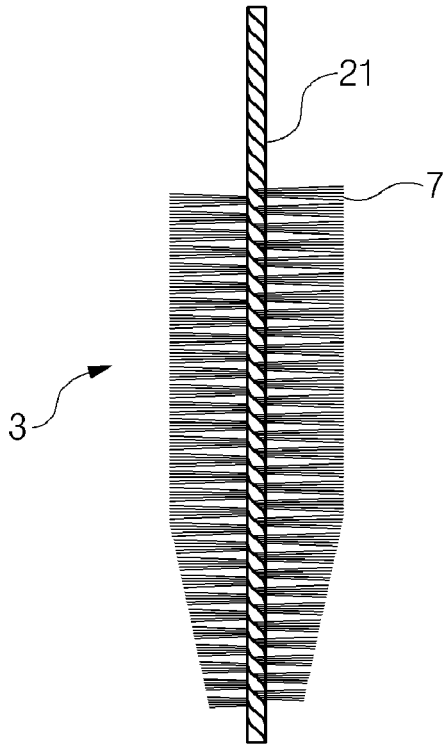
FIGS. 7*a* and 7*b* are front and bottom views of an application brush part according to a second embodiment of the present invention, respectively, wherein cutaway portions are formed symmetrically.
Figure 8A:
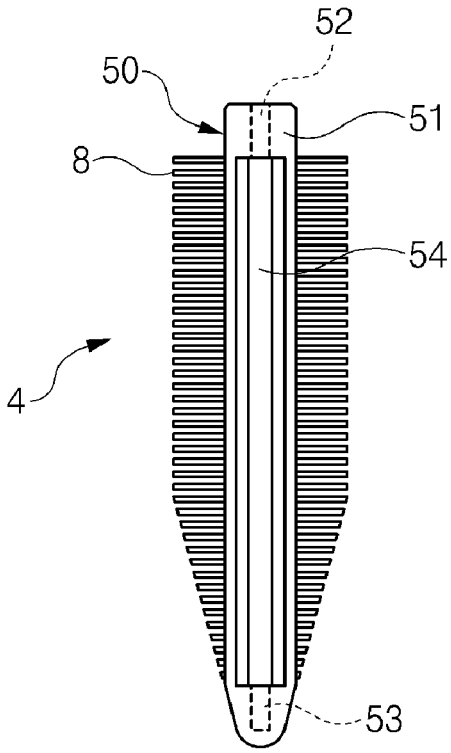
FIGS. 8*a* and 8*b* are front and bottom views of an arrangement brush part according to the second embodiment of the present invention, respectively, wherein a fixing stand having a configuration corresponding to that of the application brush part with the cutaway portions formed symmetrically is provided.

FIGS. 7*a* and 8*a* show a second embodiment of the present invention.

An application brush part 3 of the second embodiment is constructed by interposing a plurality of bristles having a constant length between and perpendicularly to two parts of a wire folded at the center thereof and spirally twisting the two wire parts a certain number of times, as described above. Thus, an application portion 7 thus formed is fixed to the rod 21 formed through the twisting of the wire parts.

Figure 7B:
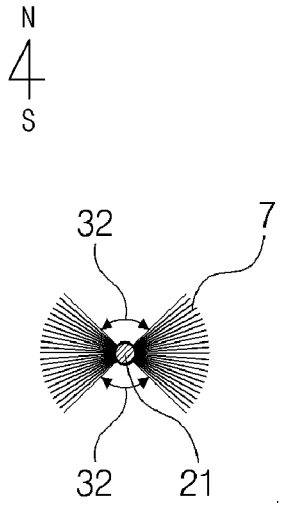

As shown in FIGS. 7*a* and 7*b*, the application brush part 3 is provided with cutaway portions 32 formed by longitudinally cutting away some sections of the application portion 7 fixed to the rod 21 symmetrically with respect to the cross section of the application brush part 3. Thus, the application portion 7 of the application brush part 3 has a symmetric configuration.

That is, in view of the four directions in the cross section of the application brush part 3, north and south sections of the application portion 7 of the application brush part 3 are cut away in a symmetric manner to form the cutaway portions 32. Thus, only east and west sections of the application portion 7 except the cutaway portions 32 symmetrically remain in the application brush part 3.

Figure 8B:
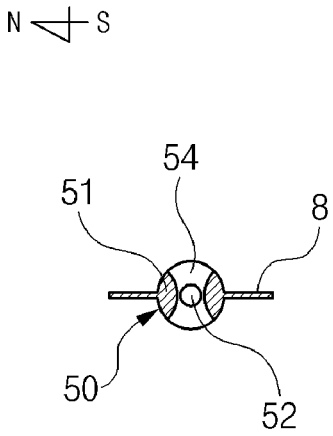

As shown in FIGS. 8*a* and 8*b*, an arrangement brush part 4 that serves as a means for arranging eyelashes smeared with the mascara liquid when coupled to the application brush part 3 has combs 8 protruding outwardly from a side surface 51 of a fixing stand 50.

The fixing stand 50 takes the shape of a cylinder and is formed with a central insertion bore 52 longitudinally therethrough so that the rod 21 of the application brush part 3 can be inserted into the insertion bore 52 to cause the fixing stand to be coupled to the application brush part 3. In order to fix the rod 21, a lower end of the fixing stand 50 is formed with an insertion recess 53 into which the distal end of the rod 21 on the side of the application portion 7 is fixedly inserted. Further, the side surface 51 of the fixing stand 50 is perforated symmetrically to have open windows 54 with a predetermined size such that when the fixing stand is coupled to the application brush part 3 with the cutaway portions 32 symmetrically formed therein, the existing sections of the application portion 7 of the application brush part 3 protrude outwardly through these windows.

That is, in view of the four directions in the cross section of the fixing stand 50, the open windows 54 of the fixing stand 50 are formed symmetrically to correspond to the east and west sections of the application portion 7 of the application brush part 3, and the combs 8 are formed symmetrically on north and south regions of the side surface 51 of the fixing stand 50.

Therefore, in order to couple the arrangement brush part 4 to the application brush part 3, the insertion bore 52 of the fixing stand 50 is fitted around the rod 21 with the application portion 7 formed thereon, and at the same time, the cutaway portions 32 of the application brush part 3 are placed at closed regions of the side surface 51 of the fixing stand 50 while the existing sections of the application portion 7 of the application brush part 3 are placed in the open windows 54 of the fixing stand 50. Then, the distal end of the rod 21 on the side of the application portion 7 is inserted into the insertion recess 53 of the fixing stand 50 to couple the fixing stand 50 and the rod 21 to each other.

Figure 9A:
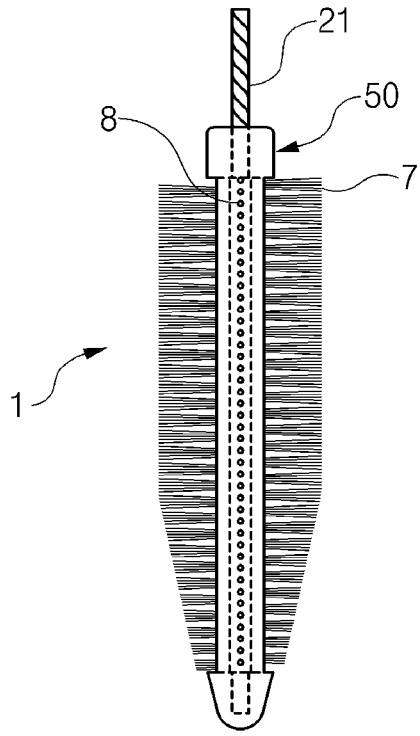
FIGS. 9*a* and 9*b* are front and bottom views showing a state where the application brush part of FIG. 7*a* and the arrangement brush part of FIG. 8*a* are coupled to each other, respectively.
Figure 9B:
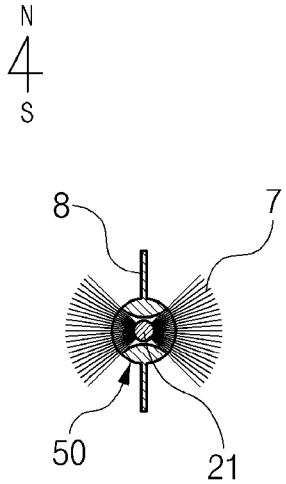

Accordingly, both the application brush part 3 and the arrangement brush part 4 are provided on the single brush rod 2. As shown in FIGS. 9*a* and 9*b*, the existing sections of the application portion 7 of the application brush part 3 are placed symmetrically in the east and west directions of the brush rod 2, and the combs 8 of the arrangement brush part 4 are placed symmetrically in the north and south directions of the brush rod 2. When the mascara brush 1 with the integrally formed application and arrangement brush parts 3 and 4 is used for applying the mascara liquid to the eyelashes, the effects of volume-up, long lash, curling and clean can be imparted to the eyelashes.

Figure 10A:
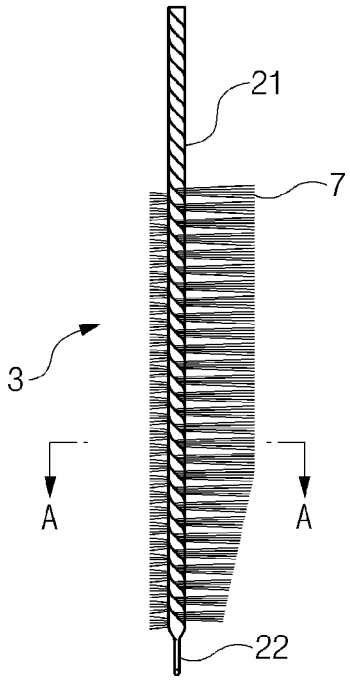
FIGS. 10*a*, 10*b* and 10*c* are a front view, a side view and a sectional view through line A-A, respectively, showing an application brush part according to a third embodiment of the present invention.
Figure 11A:
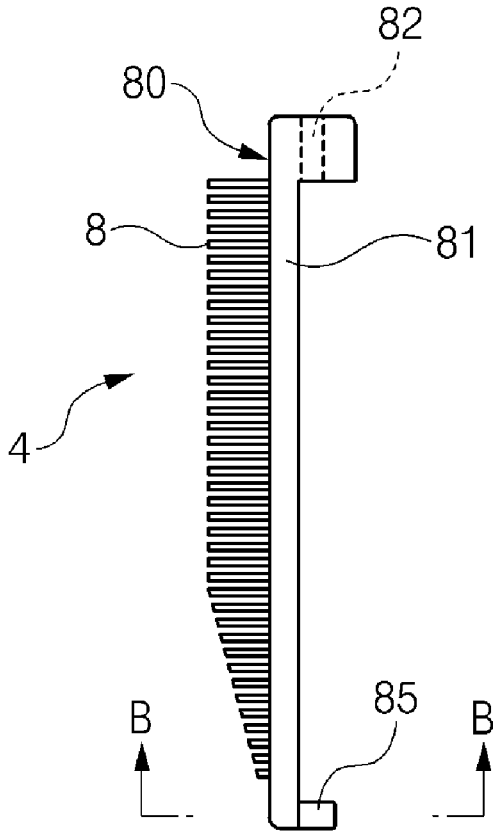
FIGS. 11*a* and 11*b* are a front view and a sectional view through line B-B, respectively, showing an arrangement brush part according to the third embodiment of the present invention.

FIGS. 10*a* and 11*a* are front views showing an application brush part 3 and an arrangement brush part according to a third embodiment of the present invention in a decoupled state, respectively. Although the brush parts of this embodiment are substantially identical with those shown in FIG. 2 in view of their configurations, the configurations of lower ends thereof are different from each other.

Figure 10B:
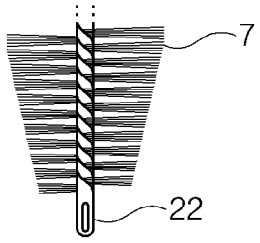
Figure 10C:
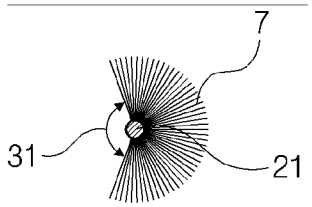

FIG. 10*a* is a front view of the application brush part, FIG. 10*b* is a side view of FIG. 10*a*, and FIG. 10*c* is a sectional view taken along line A-A of FIG. 10*a*.

The application brush part 3 is constructed by interposing a plurality of bristles between two parts of a wire folded at the center thereof and spirally twisting the two wire parts several times. Thus, an application portion 7 consisting of the bristles is fixed to the rod 21 formed through the twisting of the wire parts. Further, the application brush part 3 is formed longitudinally with a cutaway portion 31 by cutting away a section of the application portion 7 within an angular range of 30 to 120 degrees in the cross section of the application brush part 3.

A section of the application portion 7 fixed to a lowest end of the rod 21 through the twisting of the wire parts is removed so that a ring 22 can be exposed at the lowest end of the rod 21. With the ring 22, the application brush part 4 to be described later is coupled to the application brush part 3.

Figure 11B:
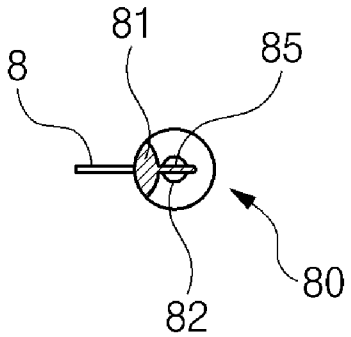

FIG. 11*a* is a front view of the application brush part, and FIG. 11*b* is a sectional view taken along line B-B of FIG. 11*a*.

The arrangement brush part 4 comprises a "⊏-shaped" fixing stand 80, and a comb 8 formed on a side surface 81 of the fixing stand 80.

The side surface 81 defining the longitudinal length of the fixing stand 80 has a length identical with or slightly shorter than that of the rod 21. An upper flange extending from the side surface 81 in a direction perpendicular thereto is formed with a fitting hole 82 into which the rod 21 of the application brush part 3 is inserted. Particularly, a lower flange extending from the side surface 81 in a direction perpendicular thereto is formed with a protruding, coupling piece 85 that is to be fixedly inserted into the ring 22 of the rod 21. Here, since the upper flange of the fixing stand 80 comes into contact with the lower end of the brush rod 2, it has a diameter identical with that of the brush rod 2. Further, since the coupling piece 85 of the fixing stand 80 should be inserted into the ring 22 formed at the rod 21, it has a proper diameter corresponding to the inner diameter of the ring 22.

Moreover, since the side surface 81 of the fixing stand 80 on which the comb 8 is formed should be placed in the cutaway portion 31 of the application brush part 3, it has a cross section conforming to the cross section of the cutaway portion 31 in view of their shapes.

Figure 12A:
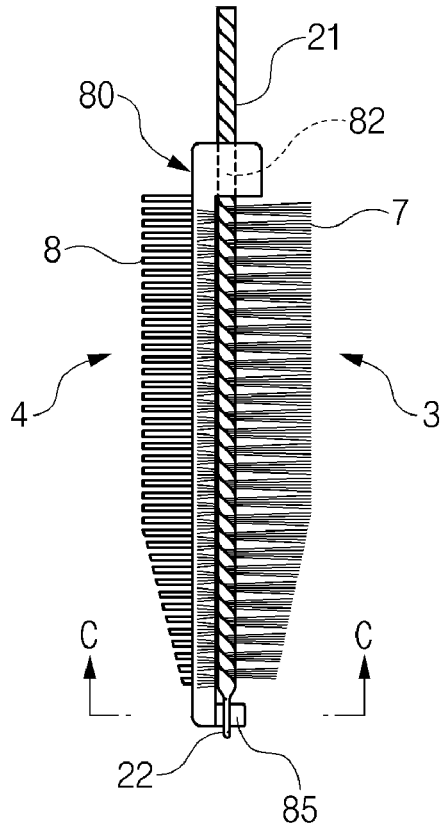
FIGS. 12*a* and 12*b* are a front view and a sectional view through line C-C, respectively, showing a state where the application brush part and the arrangement brush part according to the third embodiment of the present invention are coupled to each other.
Figure 12B:
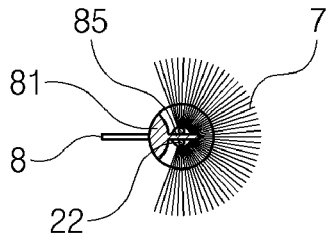

Therefore, in order to fix the arrangement brush part constructed as above to the application brush part as shown in FIGS. 12*a* and 12*b*, the fitting hole 82 of the fixing stand 80 is first fitted around the rod 21 with the application portion 7 and the side surface 81 of the fixing stand 80 is adjusted in its position to be in contact with the cutaway portion 31 of the application brush part 3. When the rod 21 is lowered up to the lower flange of the fixing stand 80, the coupling piece 85 of the fixing stand 80 is inserted into the ring 22 of the rod 21. Thus, the application brush part 3 and the arrangement brush part 4 are coupled to each other. At this time, in order to ensure more secure coupling of the coupling piece 85 to the ring 22 of the rod 21, a tip of the coupling piece 85 inserted into the ring 22 is bent or subjected to thermal bonding. As a result, the coupled state of the ring 22 and the coupling piece 85 can be firmly maintained.

Figure 13A:
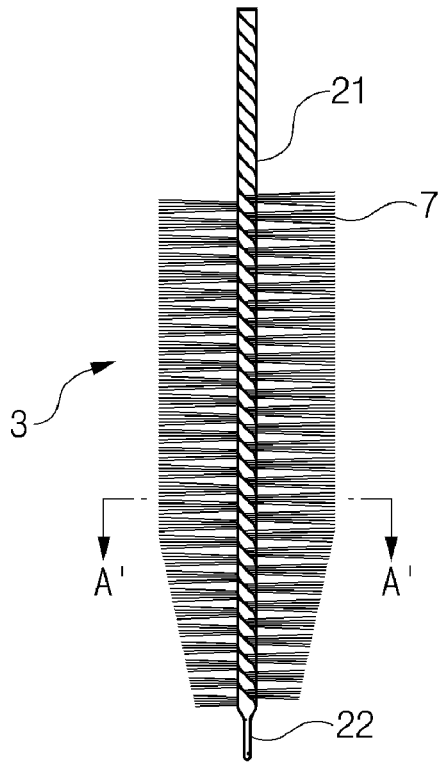
FIGS. 13*a* and 13*b* are a front view and a sectional view through line A'-A', respectively, showing an application brush part according to a fourth embodiment of the present invention.
Figure 14A:
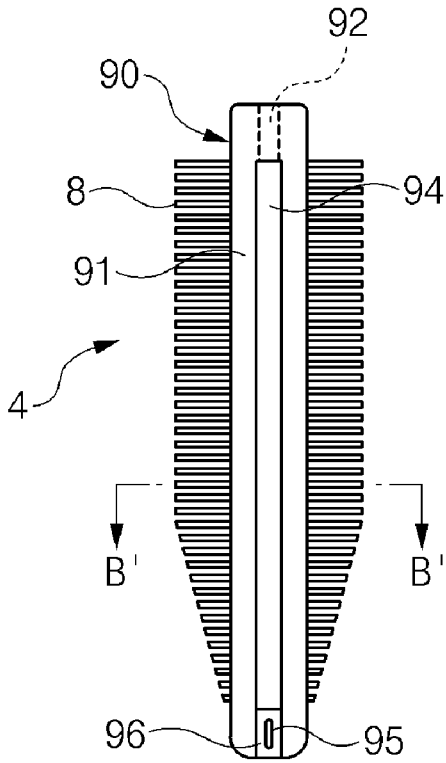
FIGS. 14*a* and 14*b* are a front view and a sectional view through line B'-B', respectively, showing an arrangement brush part according to the fourth embodiment of the present invention.

FIGS. 13*a* and 14*a* show an application brush part and an arrangement brush part according to a fourth embodiment of the present invention, respectively. Although the brush parts of this embodiment are substantially identical with the application and arrangement brush parts 3 and 4 shown in FIGS. 7*a* and 8*a* in view of their configurations, the configurations of lower ends thereof are different from each other.

Figure 13B:
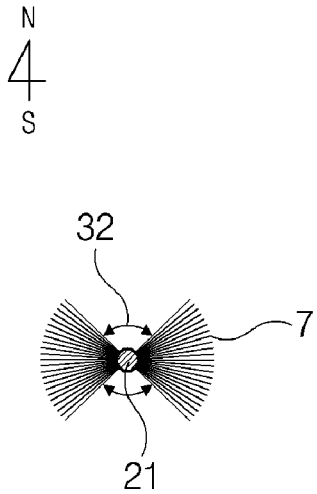

FIG. 13*a* is a front view of the application brush part, and FIG. 13*b* is a sectional view taken along line A'-A' of FIG. 13*a*.

The application brush part 3 of the fourth embodiment is constructed by interposing a plurality of bristles between two parts of a wire folded at the center thereof and spirally twisting the two wire parts a certain number of times. Thus, the application portion 7 thus formed is fixed to the rod 21 formed through the twisting of the wire parts. The application brush part 3 is provided with the cutaway portions 32 formed by longitudinally cutting away some sections of the application portion 7 symmetrically with each other. That is, in view of the four directions in the cross section of the application brush part 3, the application brush part 3 is provided with the cutaway portions 32 in the north and south directions and with the existing sections of the application portion 7 in the east and west directions.

A section of the application portion 7 fixed to the lowest end of the rod 21 through the initial twisting of the wire parts is removed so that the ring 22 can be exposed at the lowest end of the rod 21. With the ring 22, the application brush part 4 to be described later is coupled to the application brush part 3.

Figure 14B:
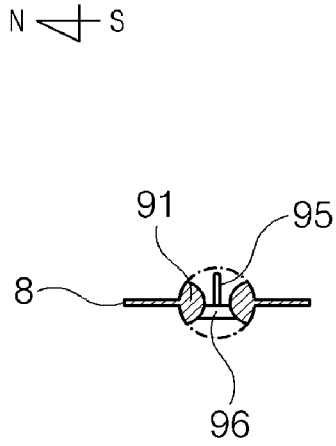

FIG. 14*a* is a front view of the application brush part, and FIG. 14*b* is a sectional view taken along line B'-B' of FIG. 14*a*.

The arrangement brush part 4 comprises a cylindrical fixing stand 90, and combs 8 formed on a side surface 91 of the fixing stand 90.

The fixing stand 90 takes the shape of a cylinder with a length identical with or slightly shorter than that of the application brush part 3, and is formed with a central insertion bore 92 longitudinally therethrough so that the rod 21 of the application brush part 3 can be inserted into the insertion bore 92 to cause the fixing stand to be coupled to the application brush part 3. The side surface 91 of the fixing stand 90 is formed with open windows 94 perforated up to a lower end of the side surface such that when the fixing stand is coupled to the application brush part 3 with the cutaway portions 32 symmetrically formed therein, the existing sections of the application portion 7 of the application brush part 3 protrude outwardly through the windows. A protruding, coupling piece 95 that is to be fixedly inserted into the ring 22 of the rod 21 is formed at the lower end of the side surface 91.

More specifically, the side surface 90 of the fixing stand 90 is divided into both lateral symmetric regions due to the formation of the open windows 94. Lower ends of the both lateral regions of the side surface 91 are connected to each other via a support 96. The coupling piece 95 is formed to protrude transversely and perpendicularly from the support 96.

That is, in view of the four directions in the cross section of the fixing stand 90, the open windows 94 of the fixing stand 90 are formed symmetrically in the east and west directions, and the combs 8 are formed symmetrically in the north and south directions on the side regions of the side surface 91 of the fixing stand 90. The coupling piece 95 is formed to protrude from a side of the support 96, which connects the side regions of the side surface 91 to each other, at a right angle with respect to the combs 8 formed on the side regions of the side surface.

Figure 15A:
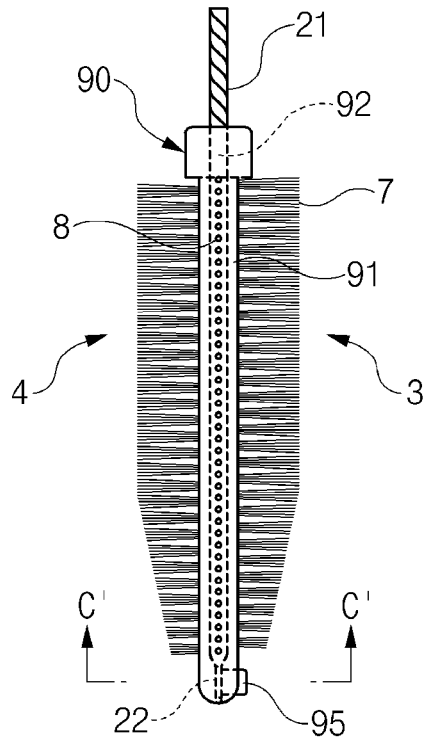
FIGS. 15*a* and 15*b* are a front view and a sectional view through line C'-C', respectively, showing a state where the application brush part and the arrangement brush part according to the fourth embodiment of the present invention are coupled to each other.
Figure 15B:
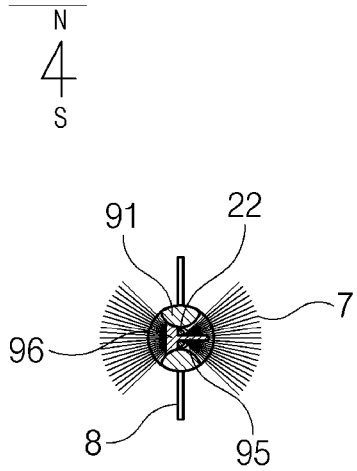

Therefore, in order to couple the arrangement brush part to the application brush part as shown in FIG. 15*a*, the insertion bore 92 of the fixing stand 90 is fitted around the rod 21, and at the same time, the cutaway portions 32 of the application brush part 3 are placed at closed regions of the side surface 91 of the fixing stand 90 while the existing sections of the application portion 7 of the application brush part 3 are placed in the open windows 94 of the fixing stand 90. Then, the coupling piece 95 of the fixing stand 90 is fixedly inserted into the ring 22 of the rod 21 that has been lowered up to the lower end of the fixing stand 90 through the insertion bore 92. As shown in FIG. 15*b*, the existing sections of the application portion 7 of the application brush part 3 are placed symmetrically in the east and west directions of the brush rod 2, and the combs 8 of the arrangement brush part 4 are placed symmetrically in the north and south directions of the brush rod 2.

Figure 16A:
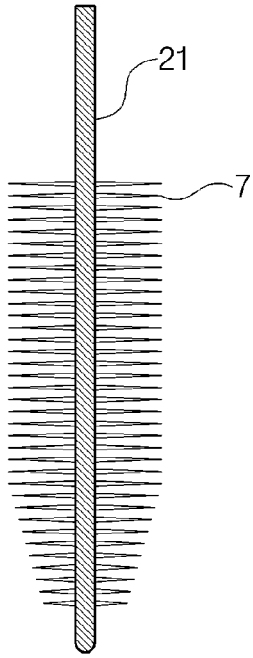
FIGS. 16*a*, and 16*b* and 16*c* are a front view and bottom views showing application brush parts according to further embodiments of the present invention.

FIG. 16*a* shows a fifth embodiment of the present invention, in which an application portion 7 of an application brush part 3 is injection molded from a synthetic resin.

More specifically, a lower end of a brush rod 2 has a rod 21 extending therefrom, which has a diameter and length identical with that of the metal wire rod 21 of the previous embodiments. The application portion 7 for applying the mascara liquid to the eyelashes is radially formed on an outer circumferential surface of the rod 21. The rod 21 is made of the same synthetic resin as the brush rod 2, e.g., polyamide. The application portion 7 formed on the outer circumferential surface of the rod 21 is also made of the same material as the rod 21 by means of injection molding using a precision mold.

Figure 16B:
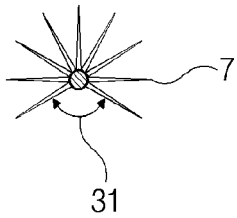

Further, a side surface of the rod 21 is formed longitudinally (perpendicularly to the cross section of the application brush part) with the cutaway portion 31 by cutting away a section of the application portion 7, as shown in FIG. 16*b*. At this time, the cutaway portion 32 is formed by longitudinally cutting away a section of the application portion 7 within an angular range of about 30 to 120 degrees about the center of the cross section of the application brush part 3.

Accordingly, the fixing stand 40 of the arrangement brush part 4 used in the first embodiment can be coupled to the application brush part 3 with the application portion 7 formed on the outer circumferential surface of the rod 21 to form a mascara brush 1, thereby applying the mascara liquid to the eyelashes.

Figure 16C:
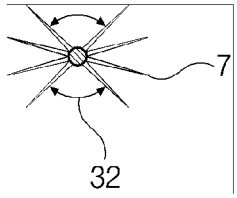

Alternatively, as shown in FIG. 16*c*, the cutaway portions 32 are formed symmetrically such that both sections of the application portion 7 formed at the both lateral sides of the rod 21 with respect to the cross section of the application brush part 3 are symmetric with each other. Thus, the fixing stand 50 of the arrangement brush part 4 used in the second embodiment can be coupled to the application brush part to form a mascara brush 1.

Figure 17A:
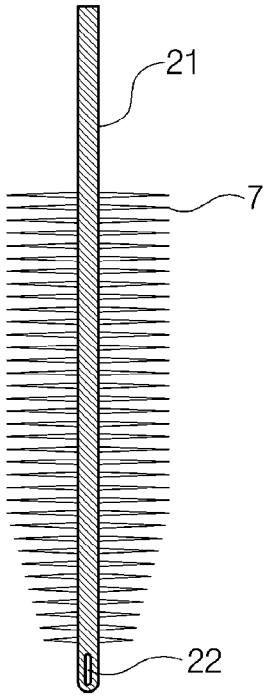
Figure 17B:
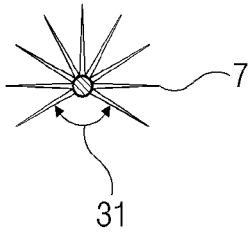

Alternatively, the fixing stand 80 of the arrangement brush part 4 used in the third embodiment can be coupled to an application brush part 3 in which the cutaway portion 31 is formed at a side of the outer circumferential surface of the rod 21 by cutting away a section of the application portion 7 and the ring 22 is formed by perforating the lower end of the rod 21, as shown in FIGS. 17*a* and 17*b*, thereby forming a mascara brush 1.

Figure 17C:
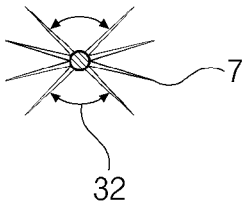
Figure 18:
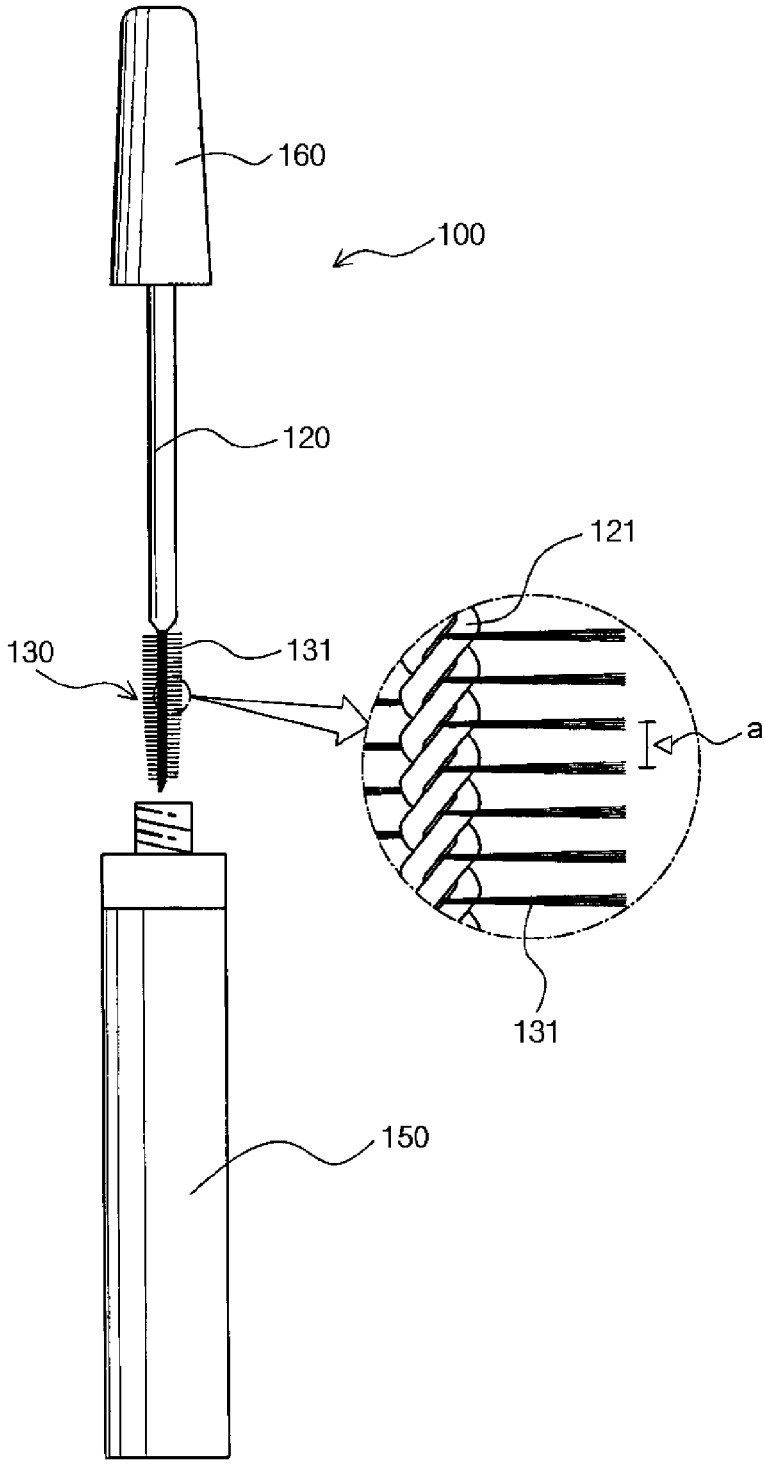
FIG. 18 PRIOR ART
* and FIGS. 18 and 19 are perspective views of conventional mascara brushes.
Figure 19:
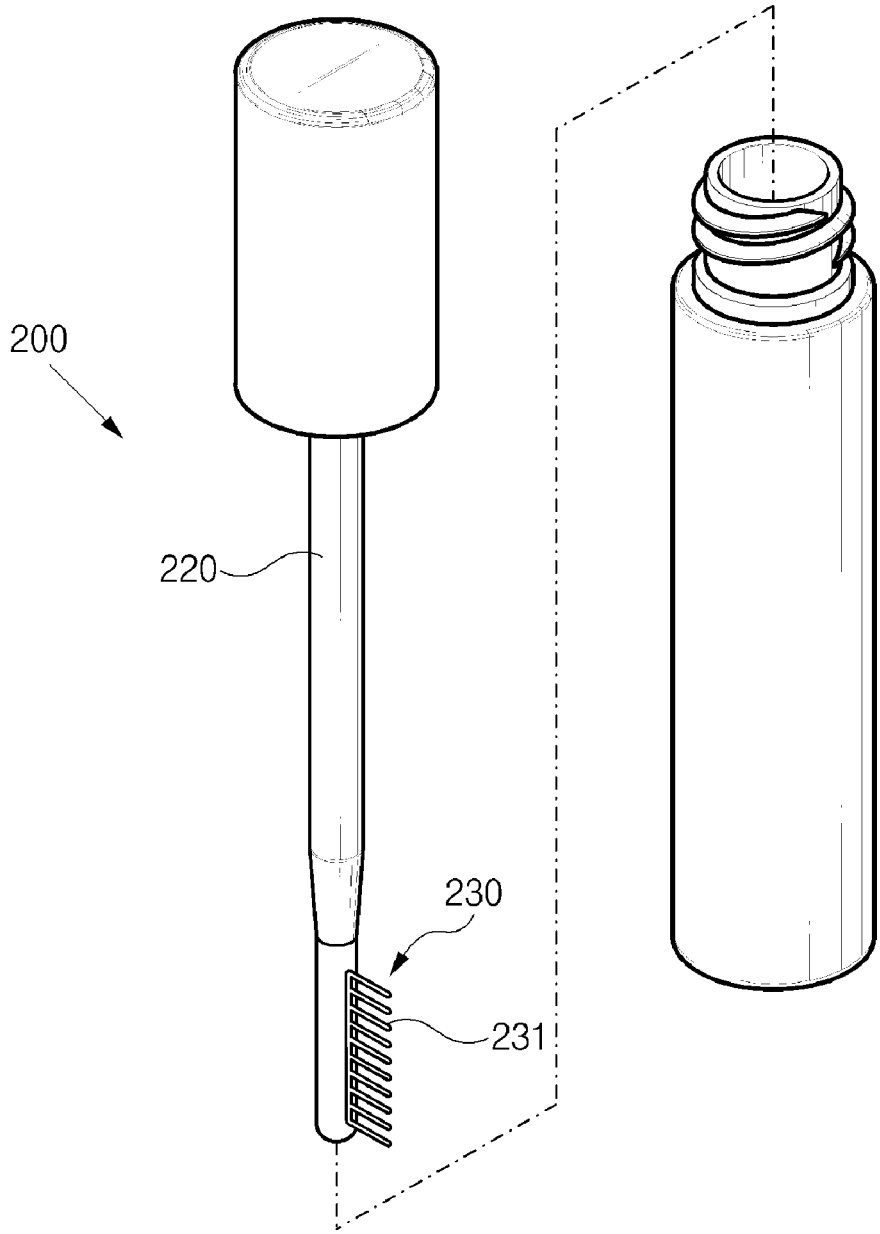
FIG. 19 PRIOR ART

Alternatively, the fixing stand 90 of the arrangement brush part 4 used in the fourth embodiment can be coupled to an application brush part 3 in which cutaway portions 32 are formed at both sides of the rod 21 by cutting away sections of the application portion 7 and the ring 22 is formed by perforating the lower end of the rod 21, as shown in FIG. 17*c*, thereby forming a mascara brush 1.

In the mascara brush of the present invention, the application brush part for receiving a large amount of mascara liquid is formed at a side of the brush rod, and the arrangement brush part with the comb is formed at the other side of the brush rod. Thus, the mascara brush can performs two functions of application and arrangement by the single brush rod. Accordingly, it is possible to provide a mascara brush capable of ensuring more convenient make-up by allowing application of the mascara liquid (volume-up effect) and arrangement of eyelashes (curling, long lash and clean effects) at one time upon application of mascara to the eyelashes.

Further, in the case where one or more columns of combs are formed in the arrangement brush part, when the mascara liquid is applied by the application brush part and the eyelashes are then arranged by the arrangement brush part, the effects of volume-up, curling, long lash and clean can be obtained. Meanwhile, even when the mascara liquid is applied to the eyelashes by using only the arrangement brush part with the plurality of columns of combs, it is possible simultaneously to obtain a weak volume-up effect, and the effects of curling, long lash and clean.

What is claimed is:

1. A mascara brush, comprising:

an application brush part (3) with an application portion (7) formed on an outer circumferential surface of a rod (21) thereof to apply a mascara liquid to eyelashes; and an arrangement brush part (4) including a fixing stand (40; 50; 80; 90) coupled to the application brush part (3), and a comb (8) formed on an outer peripheral surface of the fixing stand (40; 50; 80; 90), wherein the application brush part (3) is formed with a cutaway portion (31; 32) by longitudinally cutting away a section of the application portion (7), the comb (8) is placed in the cutaway portion (31; 32) so that the arrangement brush part (4) can be integrated with the application brush part (3); and the fixing stand (50) is formed to take the shape of a cylinder and formed with a central insertion bore (52) longitudinally therethrough so that the rod (21) can be inserted into the insertion bore (52), a lower end of the fixing stand (50) is formed with a fitting recess (53) into which a distal end of the rod (21) on the side of the application portion (7) is fixedly inserted, both sides of the fixing stand (50) are perforated to have open windows (54) such that existing sections of the application portion (7) of the application brush part (3) protrude outwardly through the windows (54), and the comb (8) is formed on a side surface (51) of the fixing stand (50) in a longitudinal direction of the fixing stand (50).

* * * * *